US007084388B2

(12) United States Patent
Rejc

(10) Patent No.: US 7,084,388 B2
(45) Date of Patent: Aug. 1, 2006

(54) DEVICE FOR AUTOMATICALLY ACTUATING A DOOR, IN PARTICULAR A VERTICAL DOOR

(75) Inventor: Petra Rejc, Landshut (DE)

(73) Assignee: EFAFLEX Tor–und Sicherheitssysteme GmbH & Co. KG (DE)

( * ) Notice: Subject to any disclaimer, the term of this patent is extended or adjusted under 35 U.S.C. 154(b) by 0 days.

(21) Appl. No.: 10/502,746

(22) PCT Filed: Jan. 27, 2003

(86) PCT No.: PCT/EP03/00809

§ 371 (c)(1),
(2), (4) Date: Mar. 31, 2005

(87) PCT Pub. No.: WO03/064802

PCT Pub. Date: Aug. 7, 2003

(65) Prior Publication Data

US 2005/0224700 A1 Oct. 13, 2005

(30) Foreign Application Priority Data

Jan. 28, 2002 (DE) ..... 102 03 145

(51) Int. Cl.
*H01J 39/12* (2006.01)

(52) U.S. Cl. ..... 250/221; 340/545.1

(58) Field of Classification Search ..... 250/221, 250/222, 223; 340/545, 228, 5
See application file for complete search history.

(56) References Cited

U.S. PATENT DOCUMENTS 3,852,592 A * 12/1974 Scoville ..... 250/221
4,565,029 A 1/1986 Ranaudo et al.
4,967,083 A * 10/1990 Kornbrekke et al. ..... 250/341.7
5,001,557 A 3/1991 Begle
5,192,979 A * 3/1993 Grage et al. ..... 356/28.5
5,286,967 A * 2/1994 Bates ..... 250/205
5,508,511 A * 4/1996 Zur et al. ..... 250/222.1
6,133,825 A * 10/2000 Matsuoka ..... 340/436
6,218,940 B1 * 4/2001 Rejc et al. ..... 250/221

FOREIGN PATENT DOCUMENTS

WO 93/04255 A 3/1993

* cited by examiner

*Primary Examiner*—Thanh X. Luu
*Assistant Examiner*—Tony Ko
(74) *Attorney, Agent, or Firm*—Nixon & Vanderhye PC

(57) ABSTRACT

The invention relates to a device for automatically actuating a door, in particular a vertical door, which aims to replace to a great extent known signal generation devices or control signal sensors for opening the door or for the security monitoring of the closing motion of the door. This is achieved by a detector of a security system, which is configured as a scanner detector and operates according to reflective principles, for monitoring an area by allocation to one of the ground level aprons of the door, said detector being mounted in the vicinity of a lateral border of the door opening, at a height, which is adjusted to the maximum height of objects supported on the relevant apron that are not to be registered as obstacles. The scanning beam of said detector scans a horizontal fan-shaped area, which covers the relevant apron and has a low vertical depth, determined by the depth of the scanning beam, as the monitoring area. The radial dimension of said fan-shaped area, which is determined by the maximum measuring range of the scanning detector, is selected according to the size of the relevant apron.

12 Claims, 7 Drawing Sheets

DEVICE FOR AUTOMATICALLY ACTUATING A DOOR, IN PARTICULAR A VERTICAL DOOR

This application is the US national phase of international application PCT/EP03/00809 filed 27 Jan. 2004, which designated the US and claims priority to DE Application No. 102 03 145.2 filed 28 Jan. 2002. The entire contents of these applications are incorporated herein by reference.

BACKGROUND OF THE INVENTION

1. Field of the Invention

The invention relates to a device for automatically activating a door, in particular a lifting door, which has an essentially vertical opening plane, an inner side and an outer side, and approach areas which are level with the floor and are respectively located on the inner side and on the outer side.

2. Description of Related Art

It is generally known that with automatically activated doors it is necessary to take safety precautions to prevent obstructing objects or persons who are located in the door opening from being damaged or injured when the door is automatically closed.

For this purpose, it has been known to arrange touch-sensitive contact strips on the closing edges of automatically activated doors, which strips deactivated the door drive or reversed it to the opening direction as soon as the respective touch-sensitive contact strip was in contact with an obstructing object or a person located in the door opening.

Another known solution for protecting obstructing objects or persons before a closing, automatically activated door strikes them has been to extend a number of photoelectric barriers across the opening plane of the door or to provide the opening plane of the door with what is referred to as a light curtain by means of a scanning light beam, a signal for deactivating or reversing the drive for the automatically activated door being generated when said curtain is infringed at any point of the part of the opening plane which has not yet been taken up by the closing door. A very advantageous system of this type is described, for example, in U.S. Pat. No. 6,218,940.

Automatically activated doors for very large door openings, for example of aircraft hangars, fire service equipment halls, assembly halls and the like move at comparatively high speed both in the opening direction and in the closing direction, for which reason it may be found that even though an obstructing object which is to be moved to the door opening and has a part, for example the tips of forklift truck prongs, which is near to the floor and extends to the opening plane, infringes the light and brings about the triggering of a detector signal which triggers the deactivation or reversal of the door drive, the deactivation or reversal of the door movement does not take place promptly enough for subsequent, upwardly projecting parts of the obstructing object, which is to be moved onto the opening plane, to be sensed by the closing door and are thus damaged, and in particular also damage the door seriously.

Attempts have been made to counter these problems by installing in addition to a security system which provides a light curtain which extends across the opening plane of the door opening, for example by means of a detector beam or a plurality of detector beams, a further safety system which contains a movement sensor which is installed approximately in the center of the door opening and which directs detector radiation fields onto an approach area in front of the opening plane and whose infringement by an obstructing object which is moving toward the opening plane of the respective door, or by a person who is moving in a corresponding way, causes the automatic door drive to be controlled in the door opening direction. The radiation fields of such movement sensors are fixed in this context.

In these known systems, the proximity sensor which is to be provided in addition to the light curtain which monitors the door opening plane and which monitors approach areas on the inner side of the door or outer side of the door entails additional expenditure on equipment. It has also become apparent that the detector radiation fields of known proximity sensors monitor the respective approach area only in a discontinuous fashion in such a way that, for example, a child can pass through between the monitoring radiation beams and thus reach the opening plane of the closing door without "advance detection". Finally, movement sensors which are mounted above the opening of the door have the disadvantage that, at a short distance in front of the opening plane, detector beams of the proximity sensor are directed very steeply downward onto the approach area to be monitored and therefore a horizontal speed of an obstructing object which is to be sensed or of a person which is to be sensed only has a very small speed component in the direction of the detector beam, such that movement sensors which operate according to the Doppler principle often have an inadequate sensitivity for the region of the approach area which is located near to the opening plane.

It is to be noted that it is generally known to scan vertical monitored regions, for example the facades of houses or else horizontal monitored regions, for example areas of land, using scanning beams of a laser radar scanning detector and in this way to generate a monitoring signal when the respective monitored region is infringed, said signal being fed to a corresponding evaluation means. Furthermore it is known to generate a light curtain by means of a laser radar scanning detector within a door opening which is located in a vertical plane, a monitoring signal which is used to control the door being triggered by means of the detector when said light curtain is infringed by an obstacle.

BRIEF SUMMARY OF THE INVENTION

The invention is intended to achieve the object of configuring a device for automatically activating a door, in particular a lifting door, which has an essentially vertical opening plane, an inner side and an outer side, and approach areas which are near to the floor and are respectively located on the inner side and on the outer side, in such a way that a high degree of safety is achieved both against damage to obstructing objects or injury to persons impacting against the closing door as well as against damage to the closing door by obstructing objects without a plurality of different monitor systems having to be provided.

The invention is also intended to provide a device for automatically activating a door which is very largely capable of replacing the known signal generating devices or control signal generators for opening the door or for monitoring the safety of the closing movement of the door, these being, for example, induction loops which are let into the approach areas, movement sensors of all types, mats which react to pressure, photoelectric barriers, scanning strips, pull switches and the like.

This object is achieved according to the invention by means of an automatically activatable door, in particular a lifting door, which has an essentially vertical opening plane, lateral delimitations, an inner side and an outer side and approach areas which are level with the floor and are respectively located on the inner side and on the outer side, and an activating device, which comprises the following: a door drive which is coupled to the door; a monitor system, containing a detector which operates according to the reflection principle and has the purpose of monitoring a region assigned to one of the approach areas, by means of a detector beam for obstructing objects which possibly block a closing movement, the monitor system generating a monitor signal when an obstructing object which is located in the respective approach area is sensed; and a control device which is connected to the door drive, has a monitoring signal applied to it and has the purpose of deactivating and/or changing the direction of the door drive which is in the door closing mode, when the monitoring signal occurs; characterized in that the detector is embodied as a scanning detector which is mounted next to the lateral delimitations of the door opening at a height which is matched to the maximum height of objects which are supported on the respective approach area and are not to be sensed as obstructing objects, and which scans, with its scanning beam, a horizontal fan located above the respective approach area as a monitored region and which is shallow in the vertical direction, determined by the thickness of the scanning beam, and whose radial dimension, which is determined by the maximum measuring range of the scanning detector, is selected in accordance with the magnitude of the respective approach area.

Advantageous refinements and developments are the subject matter of the dependent claims, whose content is expressly incorporated hereby in the present description without repeating the wording at this point.

The invention is based on the idea that obstructing objects or persons which are about to penetrate the part of the opening plane which is not yet covered by a closing door, and are thus at risk of being struck by the closing edge of the door, being jammed in it or of damaging the door, are in all cases supported on the ground in one of the approach areas and therefore penetrate the aforesaid part of the opening plane of the closing door, and in all cases infringe the horizontal monitored region which is in the form of the horizontal fan emitted by the scanning detector and is superimposed on the respective approach area at a short vertical distance, in such a way that, given appropriate dimensioning of this horizontal fan, there is no longer any need for a device according to the invention to have a curtain-like monitored region extending across the door opening. Therefore, a highly simplified design of the entire device is obtained together with increased protection against injuries to persons or damage to objects or to the closing door.

It is significant that a laser radar scanning detector which is used as a scanning detector according to one preferred embodiment and which is also often referred to as a laser scanner and is generally known per se generates a highly focused detector scanning beam in such a way that a precisely defined scanning horizontal fan can be produced by the scanning detector, within which fan the distances from obstructing objects or parts of obstructing objects can be respectively measured by means of the scanning beam, in such a way that polar coordinates, that is to say beam angles and radial obstruction distance, can be collected with respect to individual points on obstructing objects in relation to the transmitter location as the zero point. The data which is collected in this way can be processed in a variety of ways by comparing corresponding coordinate values from successive scanning cycles. Different evaluations and correspondingly different processing programs can be executed without a significant restructuring of the equipment for the device which is proposed here being necessary as a result.

Examples of a specific evaluation of the polar coordinate values—acquired in successive scanning cycles—of obstructing object points are the lateral movement exclusion function, i.e. the exclusion of such detector output signals from a door activation process for deactivating the closing movement or deactivating and reversing the door into the opening movement which indicate that the detector has sensed an object moving in parallel with the door closing plane; in addition the exclusion of detector output signals from a door control operation if such detector output signals indicate static obstacles which are always located in the approach area, or indicate objects which have been left in the approach area and remain motionless for a specific time.

BRIEF DESCRIPTION OF THE DRAWINGS

A number of embodiments will be described in more detail below with reference to the drawing, in which.

DETAILED DESCRIPTION OF THE INVENTION

The scanning detector which is mentioned in the following statement is preferably a laser radar scanning detector. The direction of the finely focused scanning beam of the scanning detector can be determined by the directional beam of the transmission and reception device.

Figure 1:
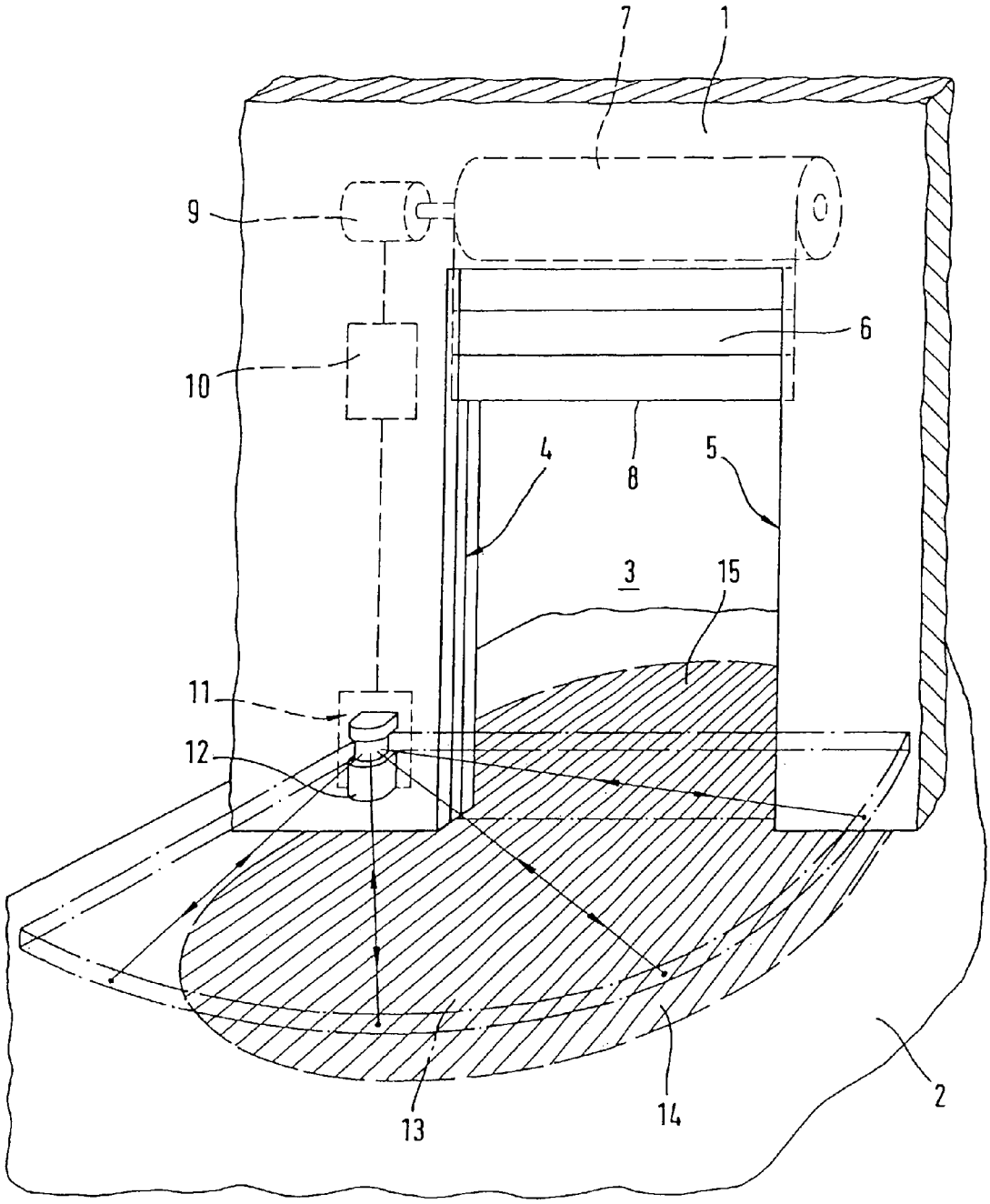
FIG. 1 is a schematic, perspective view of a part of a building with a door opening which can be closed by an automatically activated rolling door, and a monitor system in a device of the type specified here, according to a first embodiment.

FIG. 1 indicates a part 1 of a building which projects from the plane 2 of the floor and is penetrated by a door opening 3. At the lateral delimitations 4 and 5 of the door opening 3 there are door guiding and supporting structures, for example guide rails, in which a laminated roller door 6 is guided, which can be wound onto a roller 7 in order to open the door, or unwound from the roller 7 in order to close the door, with the result that the closing edge 8 of the roller door 6 ultimately drops as far as the plane 2 of the floor. The roller door 6 is moved automatically by means of a door drive 9 which is coupled to a control device 10 to which control signals are fed (in a fashion which is not illustrated) from a manually activated switch in such a way that an operator can bring about the opening or closing of the roller door 6.

Furthermore, the control device 10 is connected to a monitor system 11 which contains a detector 12 which operates according to the reflection principle. The present exemplary embodiment is a laser radar scanning detector which is mounted near to the lateral delimitation 4 of the door opening 3 on the side of the door facing the viewer. The laser radar scanning detector 12 generates, as monitored region, a horizontal fan 13 in the form of a circular segment which extends, for example, through 90°. The laser radar scanning detector 12 is mounted at such a height above the plane 2 of the floor, on the part 1 of the building next to the door opening 3, that the horizontal fan 13 is somewhat higher than the maximum height of animate beings or objects which are not to be sensed as obstructing objects. Examples of such objects are fragments of earth from the twin tires of trucks, relatively small amounts of lost packaging material, birds which have landed on the floor, and the like. The height above the plane 2 of the floor may be, for example, 5 cm to 50 cm, it being necessary to provide lower values, preferably over the inside approach area, and higher values over the outside approach area.

The approach areas 14 and 15, respectively, which are indicated by hatching are located, for example, on the outer side facing the viewer and the inner side facing away from the viewer, of the monitored door, said approach areas 14 and 15 each covering a semicircular region in front of or behind the door opening on the plane 2 of the floor in the selected example, the diameter being larger than the width of the door opening. The radius of the circular-segment-shaped horizontal fan 13, that is to say of the monitored region of the laser radar scanning detector 12, is selected in such a way that the horizontal fan 13 covers the approach area 14 in all cases.

The radius of the horizontal fan 13, that is to say the maximum measuring range of the scanning detector 12, can be determined, for example, in that, after a radar pulse is emitted, the reception channel is kept open for the reception of any echo signals only during a limited time period which is determined by twice the propagation time of a radar pulse over the radius of the fan.

In the embodiment according to FIG. 1, a range or maximum measuring range which is constant over the region which is scanned by the scanning beam is provided such that the radius of the horizontal fan 13 is equal approximately to the width of the door opening 3 plus twice the lateral offset of the laser radar scanning detector 12 with respect to the lateral door delimitation 4, as is apparent essentially from FIG. 1.

Since the laser radar scanning detector 12 is mounted on the side of the part 1 of the building, the horizontal fan 13 is shaded, with respect to the door opening 3, by the wall of the part 1 of the building which is adjacent to the scanning detector 12, in such a way that the scanning detector is capable of generating only a horizontal fan 13 which is positioned over the outer approach area 14.

Figure 2:
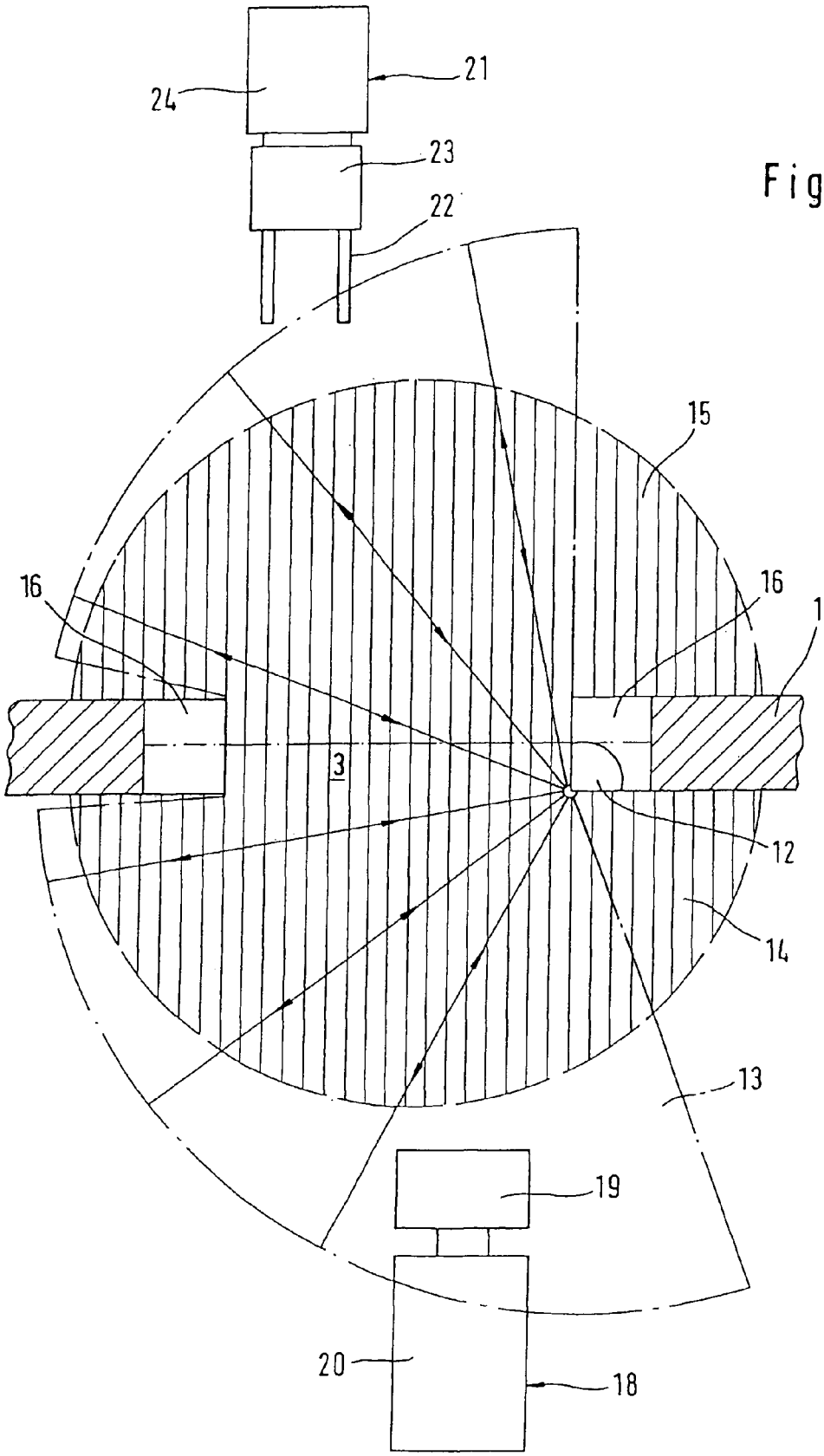
FIG. 2 shows a plan view of a part of a building which is partially shown in a horizontal section and has a door opening and a device of the type specified here, according to a second embodiment.

However, if, according to FIG. 2, the scanning detector 12 is mounted directly on an edge of the inner surface of the door opening 3 or on an inwardly pointing edge of the door guiding and supporting structures 16, the shadowing of the horizontal fan 13 by the parts of the building or door guiding and supporting structure parts which are adjacent to the scanning detector 12 is significantly less so that the horizontal fan 13 can then have, for example, an angular extent of 220° and not only the outside approach area 14 but also the inside approach area 15 of the door, and also the floor region directly in the door opening 3 are covered in such a way that a continuous monitored region over both approach areas is obtained, at least during the period of time in which the roller door 6 is located with its lower edge or with its closing edge 8 above the level at which the scanning detector 12 is mounted.

Figure 3:
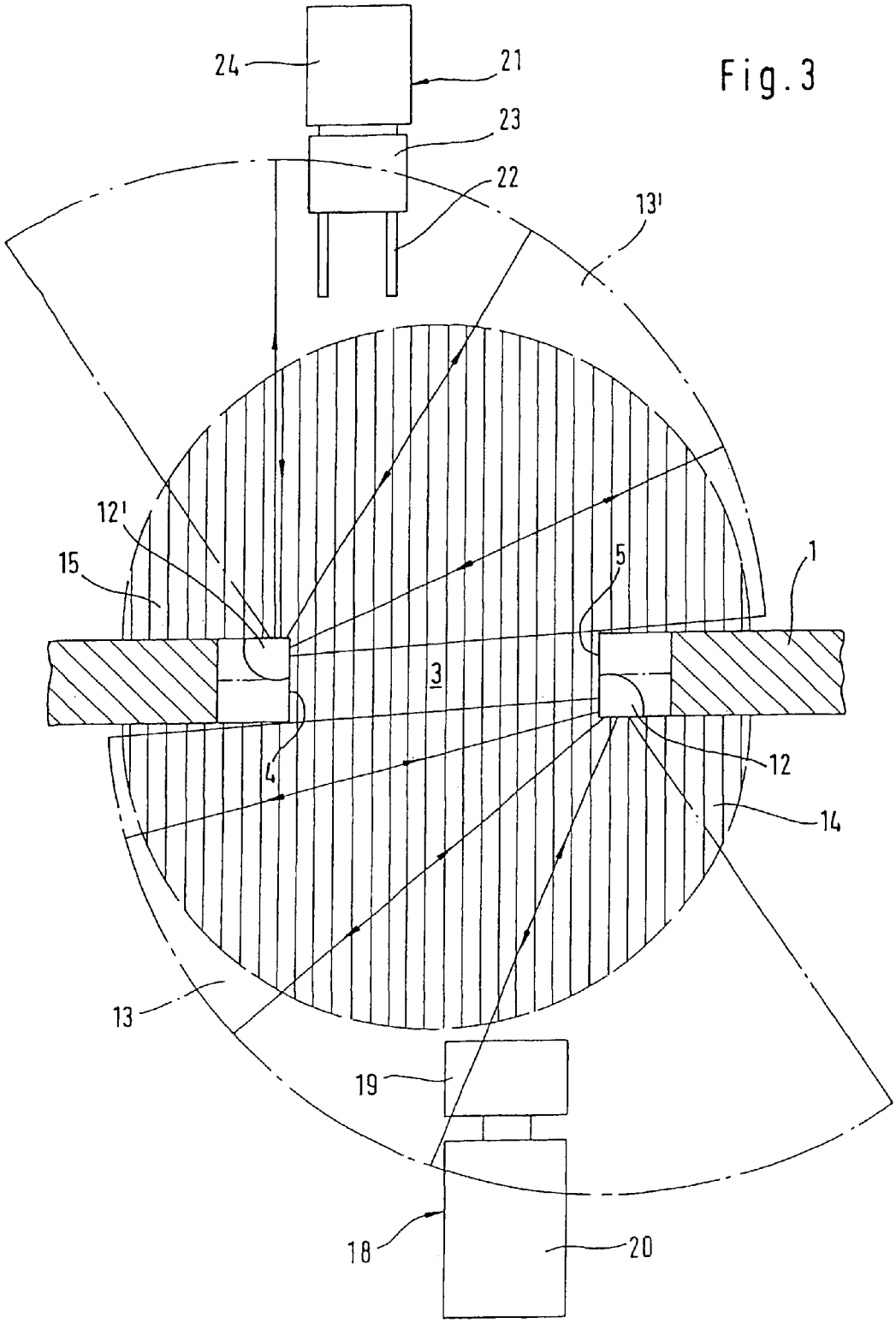
FIG. 3 shows a similar representation to FIG. 2 in a plan view with a device of the type specified here, according to a third embodiment.

If it is desired to use scanning fans of a scanning detector arrangement both on the inner side and on the outer side of the gate to provide coverage of approach areas by means of monitored regions which are in the shape of horizontal fans and which also extend to the side of the door opening 3 as far as the wall 1 of the building, as is shown for the approach areas 14 and 15 in FIG. 1, two scanning detectors 12 and 12' can be provided according to the embodiment in FIG. 3, one of which scanning detectors is mounted, for example, near to the right-hand lateral delimitation 5 of the door opening 3, facing the outside of the door, and scans the horizontal fan 13 as a monitored region, while the other scanning detector 12' is mounted near to the lateral delimitation 4 of the door opening 3 on the inner side, and generates the horizontal fan 13'. Both horizontal fans 13 and 13' are also retained when the roller door is completely closed, while in the embodiment according to FIG. 2 the part of the horizontal fan 3 which is in the shadow of the roller door and which is superimposed on one of the approach areas, is in the shadow when the roller door is closed. The outputs of the scanning detectors 12 and 12' can be connected by means of an OR logic operation and fed to the control device 10 (see FIG. 1).

FIGS. 2 and 3 show situations in which the outside approach area 14 and the inside approach area 15 are at risk of being entered by obstructing objects which are moving toward the door opening 3. An obstructing object 18 which is located on the outer side, near to the approach area 14, is, for example, in the form of a truck with a low driver's cab 19 and a rear superstructure 20 which projects to a great height. The obstructing object which approaches from the inner side of the door opening 3 is, for example, in the form of a forklift truck 21 with lifting prongs 22 which protrude at a low level, a loaded pallet 23 which is supported thereon, and the chassis with the driver's cab 24 arranged thereon. It is apparent that, irrespective of the height profile of the obstructing object which approaches the door opening 3, said object must be supported in all cases on the floor in the approach area 14 or in the approach area 15 on the way to the door opening 3, and for this reason in all cases the supporting means, for example wheels, tires and the like, are detected promptly by the monitored region in the form of the horizontal fan 13 or the horizontal fans 13 and 13', and the door drive 9 is deactivated or reversed in such a way that there is no need for the monitoring light curtain, extending to a specific height, in the opening plane of the door opening 3.

Figure 4:
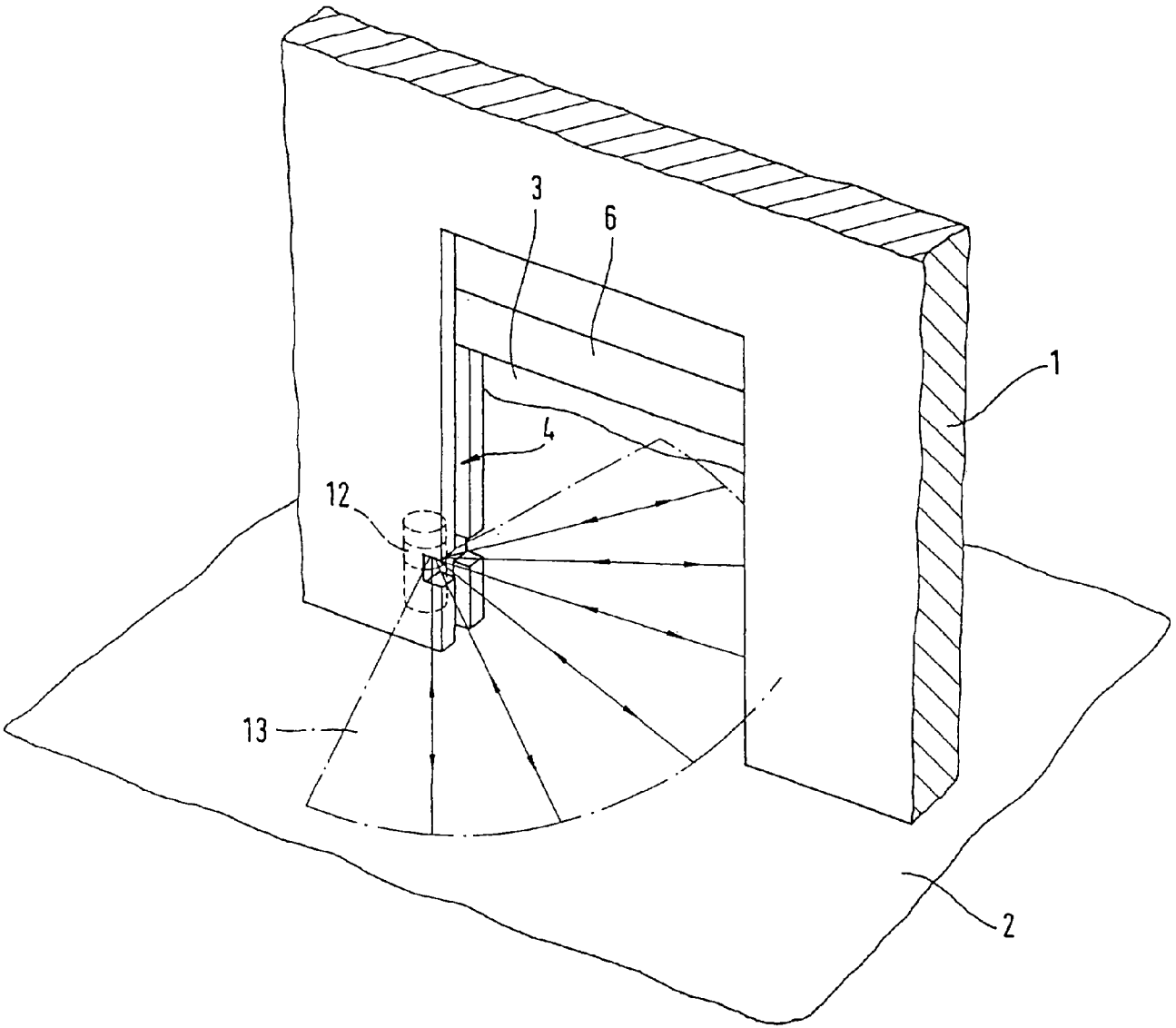
FIG. 4 shows a perspective view, seen from above, of a part of a building with a door opening and a device of the type specified here, according to a fourth embodiment.

FIG. 4 shows the possibility of using a single scanning detector 12, which is arranged near to a lateral delimitation, for example near to the lateral delimitation 4, of the door opening 3, to generate a horizontal fan 13 as a monitored region which both superimposes an approach area on the outer side and an approach area on the inner side of the door opening. For this purpose, a chamber, in which the scanning detector 12 is installed, is built into the part 1 of the building which contains the door opening 3, near to the lateral delimitation 4 of the door opening. From the chamber, a passage extends to the lateral delimitation 4 of the door opening 3, this passage also extending through door guiding and supporting structures on the respective lateral delimitation of the door opening 3 in such a way that these door guiding and supporting structures are interrupted over a short vertical distance at the height where the scanning beam exits, so that the scanning beam can pass through freely and can scan through the horizontal fan which extends, for example, over 150°.

Figure 5:
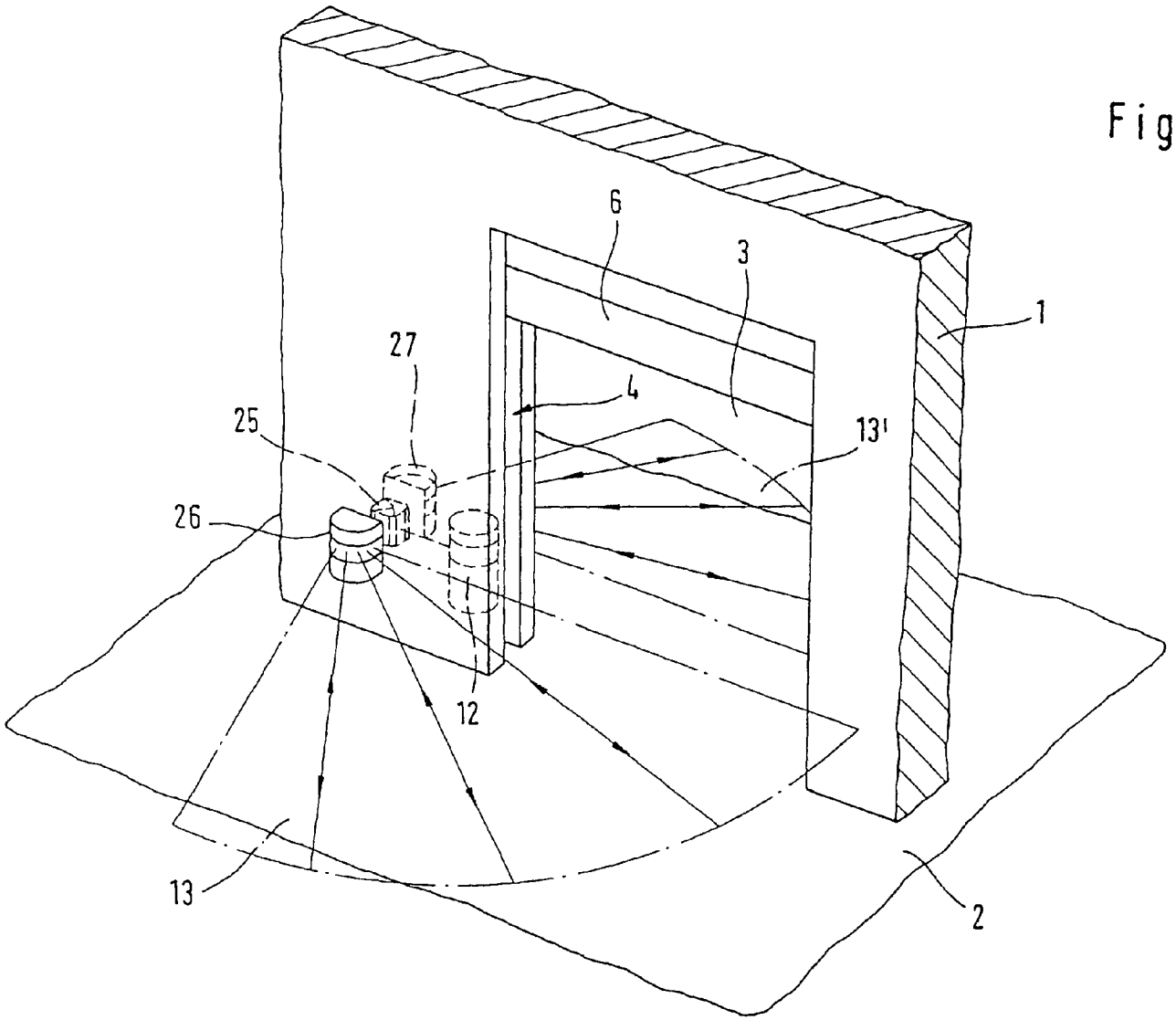
FIG. 5 shows a similar view to FIG. 4 explaining a fifth embodiment.

Another possible way of using a single scanning detector 12 to generate monitored regions which are superimposed on the inside approach area and the outside approach area is shown in FIG. 5. Here too, a chamber for accommodating the scanning detector 12 is provided in the part 1 of the building containing the door opening 3, near to the lateral delimitation 4 of the door opening. However, said scanning detector 12 does not transmit its scanning beam directly in the direction of the door opening 3 but rather onto a distributor mirror 25 which is also located within a chamber of the part 1 of the building and which transmits the scanning beam to deflection mirrors 26 and 27 which are mounted on the outer side and on the inner side of the part of the building. Horizontal ducts which are provided for the beam path therefore extend from the distributor mirror 25 through the wall thickness of the part 1 of the housing and to the deflection mirrors 26 and 27, from which the monitored regions then proceed in the form of horizontal fans 13 and 13', respectively.

Embodiments according to FIGS. 4 and 5 have the advantage that horizontal fans—superimposed on the outside approach area and the inside approach area—of the scanning beams of the scanning detector 12 are retained even if the roller door has been lowered to below the level of the scanning detector 12. The following is to be noted with respect to the evaluation of the output signals of the scanning detector 12 in a signal processing device which is associated with the monitor system 11:

If, according to the preferred embodiment in which the scanning detector 12 is a laser radar scanning detector, a transmission pulse is emitted at a specific time, the time during which the reception channel for the reception of echo signals is kept open after the emission determines the radial dimensioning of the horizontal fan 13 and 13', respectively, which is emitted by the scanning detector 12. In the embodiments according to FIG. 1 to 5, the reception channel is kept open, for example, for a constant time period after the emission of the transmission pulse, for which reason the horizontal fans 13 and 13', respectively, are each essentially in the form of a circular segment.

Figure 6:
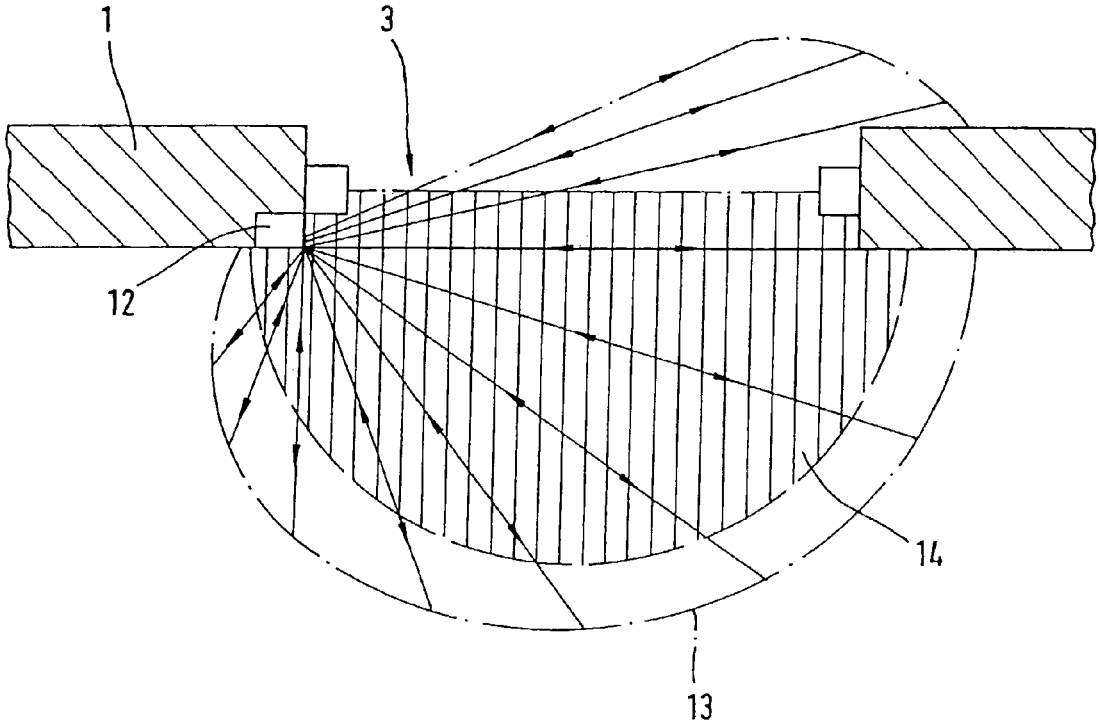
FIG. 6 shows a plan view of a part of a building with a door opening and a device according to a sixth embodiment.

However, according to FIG. 6, it is also possible to select the time period for which the reception channel is kept open after the emission of the transmission pulse as a function of the angle through which the scanning beam is scanned in the horizontal plane, with the result that a horizontal fan 13 is obtained which, despite the laterally offset arrangement of the scanning detector 12, superimposes an approximately semicircular approach area 14 onto the outer side of the door opening 3.

It goes without saying that wherever the scanning beam of the scanning detector 12 which scans within the horizontal fan 13 and 13', respectively, strikes the part 1 of the building, for example the lateral delimitation 5 of the door opening 3 which lies opposite the location where the scanning detector 12 is mounted (for example embodiments according to FIGS. 2, 4 and 6), the scanning detector 12 would signal an obstructing object which infringes its monitored region in the form of the horizontal fan, in such a way that the monitor system generates a monitoring signal and triggers the deactivation or reversal of the door drive 9. In order to prevent this, signal processing is carried out on the output signals of the scanning detector, which processing provides a fixed target suppression function, as is known from radar technology. According to said function, monitor system output signals are generated only if a comparison between a current detector output signal and a stored detector output signal from scanning operations with analogous phases from preceding scanning cycles shows that the scanning beam has been reflected by an object which was at a different radial distance from the scanning detector, in particular was at a larger radial distance from the scanning detector during a preceding scanning cycle than was the case during the current scanning operation. The signal processing device of the monitor system therefore contains a deletion stage with storage means for storing echo signals corresponding to their origin given a predetermined position of the scanning beam, and comparison devices for carrying out punctual comparisons of current scanning signals, received from appropriate directions, for the purpose of fixed character suppression. This makes it possible for objects which are always present, for example trees, boundary posts or the like, also to be arranged or installed in the approach areas 14 and 15 without this disrupting the function of the device of the type specified here.

In a signal processing device which is acted on by the distance detector 12, it is also possible to carry out a comparison of detector output signals from scanning directions of the scanning beam which are adjacent in terms of angle from the same scanning cycle or else from successive scanning cycles, with the result that signals are acquired in accordance with an item of information about the direction of movement of an obstructing object. These comparison results which contain movement information and information about the direction of movement can be linked to the monitoring signals using logic operations, in such a way that the door drive 9 is switched off or reversed whenever obstructing objects which move in the approach areas 14 and 15 have a relatively large movement component in the direction of the door opening 3. The signal processing device can therefore execute specific signal processing programs which permit an obstructing object to be tracked, said programs being executed in such a way that whenever obstructing objects move horizontally in parallel with the opening plane of the door opening 3, no monitoring signals are generated, whereas monitoring signals are derived from the detector signals if a movement component toward the door opening 3 is detected.

While the scanning detector, in particular therefore the laser radar scanning detector respectively supplies sets of obstacle point coordinates in the monitored region from one scanning cycle to the next, the coordinate information or the coordinate data is processed in the signal processing device preferably taking specific defined safety zones in the monitored region as a basis, it being possible to divide said monitored region into two zones, for example an absolute safety zone, which extends horizontally over the entire width of the door, and perpendicularly thereto, over a certain distance from the door closing plane, as well as a relative safety zone which is located at a relatively large distance from the absolute safety zone and at a relatively large distance from the door closing plane. In the absolute safety zone, no objects at all are tolerated. Changes cause the door to open. The door does not close again until the original state is restored. In the relative safety zone, criteria such as speed of approach and the size of the movement component in the direction of the door opening are taken into account and different control decisions are respectively taken.

The signal processing device also makes it possible to calculate the following information about the movement of an obstructing object by reference to the obstructing object coordinate information which is collected by the scanning detector in successive scanning cycles:

Entry point of the obstructing obstacle into the monitored region

Direction of entry horizontally in relation to the door closing plane

Entry speed and speed component in the direction perpendicular to the door closing plane.

This information can be taken into account in the acquisition of the monitoring signal or in order to form a specific control signal or to set a specific reaction speed of the control device.

If the activated door is a sliding rolling door with vertical door closing edge which moves horizontally in the opening direction, in parallel with itself, given the same design and the same configuration of the scanning detector the previously mentioned calculation of the entry point of an obstructing obstacle into the monitored region can be used to form the control signals which cause the door to open with a different speed depending on whether an object approaches the door opening near to the door delimitation which is located in the closing direction or near to the door delimitation which is located in the opening direction.

Figure 7:
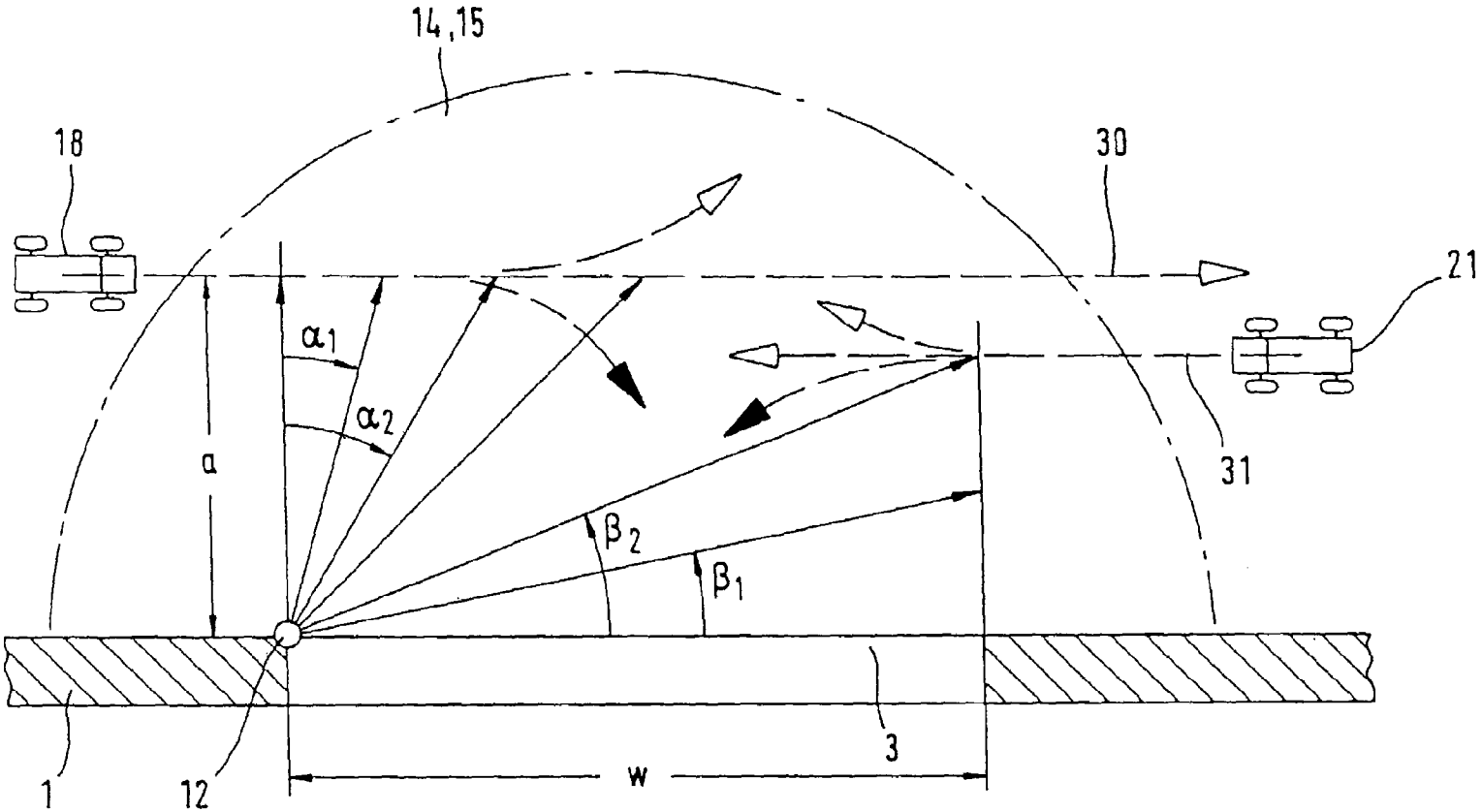
FIG. 7 shows a similar view to FIG. 6 explaining a number of geometric ideas in order to clarify particular advantages of the system specified here.

Finally, a number of geometric considerations will be taken into account with reference to FIG. 7 in order to clarify particular advantages of the system specified here, but, as will be readily seen by a person skilled in the art, the invention is not restricted to the particular mathematical treatment of the information collected by the laser scanning detector but instead other processing possibilities of the polar coordinate information of the output of the scanning detector are also possible.

In FIG. 7, a part of a building is in turn designated by 1, a door opening 3, which has a width w, being located in the part of the building. An approach area which is on the inside of the door or on the outside of the door is indicated by a dot-dashed line and designated by 14 and 15, respectively. The laser radar scanning detector 12 is mounted on one side on a door opening delimitation in the previously mentioned specific height above the approach area which is level with the floor, and transmits horizontal scanning beams in the horizontal direction with a time-dependent scanning angle $\alpha_1, \alpha_2 \ldots$ and $\beta_1, \beta_2 \ldots$, respectively.

In FIG. 7 it is assumed that the laser radar scanning detector 12 carries out time-dependent scanning in the clockwise direction in a first operating cycle (orientation angle of the scanning beam $\alpha_0, \alpha_1, \alpha_2 \ldots$) and in the directly following operation carries out time-dependent scanning in the counter-clockwise direction (scanning angle $\beta_0, \beta_1, \beta_2 \ldots$). Such scanning can be generated by means of an oscillating mirror which is provided in the beam path of the scanning beam.

If an obstructing object 18 moves in a direction parallel to the vertical plane of the door opening 3 into the approach area 14, 15, as is indicated by the arrow 30 which is indicated by means of a discontinuous line, the first scanning beam of the laser radar scanning detector 12 firstly strikes the obstructing object 18 at the scanning angle $\alpha_0$, with the result that the laser radar scanning detector 12 signals a distance a of the obstructing object from the vertical plane of the door opening 3.

All the following distance measuring values when the scanning angle assumes the values $\alpha_1, \alpha_2 \ldots$ in accordance with the angular speed of the scanning are inversely proportional to the cosine of the scanning angle $\alpha$.

If, on the other hand, an obstructing object 21 enters the approach area 14, 15 from the opposite side along a path which is indicated by the discontinuous arrow line 31 and is parallel to the vertical plane of the door opening 3, it being assumed that the obstructing object 21 is not sensed by the laser radar scanning detector 12 until it crosses over the alignment line—oriented in the horizontal direction over the approach area 14, 15 perpendicularly to the vertical plane of the door opening 3—over the lateral door delimitation which lies on the right with respect to the position in FIG. 7, the laser radar scanning detector 12 signals a radial distance of the obstructing object 21 from the laser radar scanning detector 12 of $r=w/\cos\beta$ when this alignment line is crossed.

If the arrangement is made such that obstructing objects 18 which approach from the left with respect to the illustration in FIG. 7 are to be sensed during scanning in the clockwise direction and obstructing objects 21 which approach from the right with respect to the illustration in FIG. 7 are to be sensed during scanning in the counter-clockwise direction, the geometric relationships which are given in the following table are obtained.

| Scanning in the clockwise direction | Scanning in the counter-clockwise direction |
|---|---|
| $r \cos \alpha = a$ | $r \cos \beta = w$ |
| $r_1 = \frac{a}{\cos\alpha_1}$ | $r_1 = \frac{w}{\cos\beta_1}$ |
| $r_2 = \frac{a}{\cos\alpha_2}$ | $r_2 = \frac{w}{\cos\beta_2}$ |
| $\frac{r_1}{r_2} = \frac{a/\cos\alpha_1}{a/\cos\alpha_2}$ | $\frac{r_1}{r_2} = \frac{w/\cos\beta_1}{w/\cos\beta_2}$ |
| $\frac{r_1}{r_2} = \frac{\cos\alpha_2}{\cos\alpha_1}$ | $\frac{r_1}{r_2} = \frac{\cos\beta_2}{\cos\beta_1}$ |
| $\frac{r_1}{r_2} > \frac{\cos\alpha_2}{\cos\alpha_1}$ | $\frac{r_1}{r_2} > \frac{\cos\beta_2}{\cos\beta_1}$ |
| Triggering! | Triggering! |

Therefore, if the ratio of successive distance measurements of the laser radar distance detector 12 is higher than the reciprocal value of the corresponding cosine values of the scanning angles during scanning in the clockwise direction, this means that the distance measurement of a scanning orientation which follows in the scanning direction becomes smaller and the obstructing object 18 takes on a travel component in the direction of the door opening, deviating from the path according to the arrow 30. In this case, it is necessary to trigger a monitoring signal which deactivates a closing door or reverses it into the opening direction or, if appropriate, also causes a closed door to open.

Completely corresponding considerations apply to the scanning direction in the counterclockwise direction, with scanning angles $\beta$ which become larger over time.

It is apparent that the speed with which the scanning beam passes over the approach area 14, 15 is selected to be expediently higher by an order of magnitude than an assumed maximum travel speed of the obstructing object 18 and 21, respectively, that is to say is, for example, qualitatively over ten times larger. Since the previously outlined simple trigonometric calculations can easily be carried out in the time interval when the scanning beam moves between two measuring positions, real-time processing in order to derive monitoring signals may be performed. However, in contrast to this, it may be expedient in certain cases to buffer the distance data $r_1$, $r_2$ . . . collected from the laser radar scanning detector 12 in an assignment to the orientation of the scanning beam according to the scanning angles $\alpha_1$ $\alpha_2$ . . . and $\beta_1$, $\beta_2$ . . . , respectively, over one or more scanning periods in order to acquire time for an evaluation of the coordinate data.

With respect to the case of scanning in the counter-clockwise direction according to FIG. 7 in order to sense the obstructing object 21 which moves from the right into the approach area 14, 15 with respect to the illustration in FIG. 7, it is to be noted that this obstructing object may also pivot into a radial direction with respect to the laser radar scanning detector 12 shortly after entry into the sensing region of the respective scanning beam, for which reason it is expedient also to carry out a comparison of the distance measurements of scanning beams of the same orientation of successive scanning cycles—in addition to the comparison of the measured values corresponding to adjacent scanning beams—in such a way that a monitoring signal is triggered immediately when the radial distance from the laser radar scanning detector 12 becomes smaller from one scanning cycle to the next.

The considerations presented above show that the device specified here discriminates between parallel movements relative to the door opening plane and movements in the direction of the door opening even if, in one embodiment, it has a laser radar distance detector only at a lateral door opening delimitation, by only carrying out distance measurements without the use of proximity sensor systems, in which case the signal evaluation algorithms are extremely simple and require only a minimum computational effort.

Door control photoelectric barriers, manually activated door control switches, induction loops which are used to control the door and are let into the floor of the approach areas at large expense and with considerable technical effort and have the problem of connection to any obstructing objects and light curtains, are replaced by a simple, comparatively cost-effective device which is easy to install.

The invention claimed is:

1. Automatically activatable door which has an essentially vertical opening plane, lateral delimitations, an inner side and an outer side and inner and outer approach areas which are level with the floor and are respectively located on the inner side and on the outer side, and an activating device, which comprises the following:

a door drive which is coupled to the door and has a door opening mode and a door closing mode;

a monitor system that has the purpose of monitoring a region assigned to at least one of the approach areas, the monitoring system including at least a first detector that generates a detector beam for obstructing objects which possibly block a closing movement of the door, and detects echo signals from obstructing objects, the monitor system generating a monitor signal when an obstructing object which is located in the respective approach area is sensed by the detector; and a control device which is connected to the door drive, is operatively coupled to the monitoring system to receive a monitoring signal from the monitoring system, deactivate and/or change the direction of the door drive if in the door closing mode when the monitoring signal occurs;

wherein the detector is embodied as a scanning detector which is mounted next to a lateral delimitation of the door opening at a height which is matched to the maximum height of objects which are supported on the respective approach area and are not to be sensed as obstructing objects, and which scans, with a scanning detecting beam, a horizontal fan located above the respective approach area as a monitored region and which is shallow in the vertical direction, determined by the thickness of the scanning beam, and whose radial dimension, which is determined by the maximum measuring range of the scanning detector, is selected in accordance with the magnitude of the respective approach area.

2. The door as claimed in claim 1, wherein the monitor system contains a further, second scanning detector which is mounted near to the respective other lateral delimitation of the door opening and corresponds in height and in the formation of the horizontal fan which is scanned by a scanning beam thereof, to the first scanning detector, the first scanning detector being positioned in such a way that a scanning region thereof lies essentially over the outside approach area, while the second scanning detector is positioned in such a way that a scanning region thereof lies essentially over the inside approach area.

3. The door as claimed in claim 1, wherein the door guiding and supporting structures and/or adjacent parts of a building are formed at the location where the scanning detector is mounted, near to the respective lateral delimitation of the door opening, so as to be in such way transparent and free of obstacles for the scanning beam and wherein the monitored region of the scanning detector is in the form of at least one horizontal fan which is located both over the inside and over the outside approach areas, in such a way that the scanning beam of the scanning detector senses obstructing objects both on the inside approach area and on the outside approach area.

4. The door as claimed in claim 3, wherein door guiding and supporting structures at the location where the scanning detector is mounted are interrupted over a short vertical distance in such a way that they permit free passage of the scanning beam in such a way that the horizontal fan extends uninterruptedly from the outside to the inside over the respective approach areas.

5. The door as claimed in claim 1, wherein the maximum measuring range of the scanning detector, or of each scanning detector, is controlled as a function of pivoting angle thereof in the horizontal plane of the horizontal fan.

6. The door as claimed in one of claim 1, wherein the scanning detector, or each scanning detector, is an active radar scanning detector.

7. The door as claimed in claim 6, wherein the scanning detector, or each scanning detector, is a laser radar scanning detector.

8. The door as claimed in claim 6, wherein the scanning detector, or each scanning detector, is coupled to a signal processing device in which a monitoring signal is formed from a composite signal—which exceeds a threshold value—of detector output signals corresponding to identically oriented scanning beams from a plurality of scanning cycles.

9. The door as claimed in claim 6, wherein the scanning detector, or each scanning detector, is coupled to a signal processing device in which a monitoring signal is formed by forming differences or forming relationships between current detector output signals and stored detector output signals from scanning processes with analogous phases from previous scanning cycles.

10. The door as claimed in claim 6, wherein the scanning detector, or each scanning detector, is coupled to a signal processing device in which detector output signals from scanning directions of the scanning beam which are adjacent in terms of angle from successive scanning cycles are compared in such a way that signals corresponding to information about the direction of movement of the obstructing object, in particular relating to components which are transverse with respect to the radial direction of the horizontal fan are acquired and are linked to the monitoring signals in order to be applied to the control device.

11. A method for automatically activating a door which has an essentially vertical opening plane, lateral delimitations, an inner side and an outer side and inner and outer approach areas which are level with the floor and are respectively located on the inner side and on the outer side, and an activating device, which comprises the following:

coupling a door drive to the door, the door drive having a door opening mode and a door closing mode drive;

providing a monitor system that has the purpose of monitoring a region assigned to at least one of the approach areas, the monitoring system including at least a first detector that generates a detector beam for obstructing objects which possibly block a closing movement of the door, and detects echo signals from obstructed objects, the monitor system generating a monitor signal when an obstructing object which is located in the respective approach area is sensed by the detector; and operatively connecting a control device to the door drive and to the monitoring system to receive a monitoring signal from the monitoring system and deactivate and/or change the direction of the door drive if in the door closing mode when the monitoring signal occurs;

mounting the detector next to a lateral delimitation of the door opening at a height which is matched to the maximum height of objects which are supported on the respective approach area and are not to be sensed as obstructing objects, and generating a scanning detecting beam and scanning in a horizontal fan located above the respective approach area as a monitored region, the scanning beam being shallow in the vertical direction, determined by the thickness of the scanning beam, and having a radial dimension, which is determined by the maximum measuring range of the scanning detector, selected in accordance with the magnitude of the respective approach area.

12. The method of claim 11, further comprising:

detecting an echo beam generated when the scanning beam encounters an obstructing object in the monitored region, generating a monitor signal, detecting the monitoring signal with the control device, and at least one of deactivating and/or changing the direction of the door drive when in the door closing mode.

* * * * *